US006615879B2

(12) United States Patent
Kurmis

(10) Patent No.: US 6,615,879 B2
(45) Date of Patent: Sep. 9, 2003

(54) BINDING TOOL

(75) Inventor: Viktor Kurmis, Pinneberg (DE)

(73) Assignee: Hellermann Tyton GmbH, Tornesch (DE)

( * ) Notice: Subject to any disclaimer, the term of this patent is extended or adjusted under 35 U.S.C. 154(b) by 0 days.

(21) Appl. No.: 10/073,719

(22) Filed: Feb. 11, 2002

(65) Prior Publication Data

US 2002/0108666 A1 Aug. 15, 2002

(30) Foreign Application Priority Data

Feb. 12, 2001 (EP) ..... 01103243

(51) Int. Cl.[7] ..... B21F 9/02
(52) U.S. Cl. ..... 140/123.5; 140/93.2
(58) Field of Search ..... 100/32; 140/93.2, 140/93.4, 123.5, 123.6; 226/44

(56) References Cited

U.S. PATENT DOCUMENTS 4,997,120 A * 3/1991 Tanaka et al. ..... 226/44
5,915,425 A 6/1999 Nilsson et al.

FOREIGN PATENT DOCUMENTS

EP 0 299 387 A1 1/1989

* cited by examiner

*Primary Examiner*—Lowell A. Larson
(74) *Attorney, Agent, or Firm*—Alix, Yale & Ristas, LLP

(57) ABSTRACT

Tool for binding a band (4) around an object, having a lock mount (2) for a lock which secures the band ends, a band-tensioning device (5, 6) and, if appropriate, a band-tensioning-measuring device (10). Provided between the lock mount (2) and the band-tensioning device (5, 6) is a band-tensioning-measuring device (14) which deflects the band (4) laterally and establishes the relationship between the deflection and the force necessary for this purpose.

20 Claims, 1 Drawing Sheet

BINDING TOOL

BACKGROUND OF THE INVENTION

The invention relates to a tool for binding objects, in particular cable harnesses, having a band and a lock which secures the band ends. It is often necessary to set the band tensioning within predetermined limits in order that, on the one hand, sufficient tensioning is achieved and, on the other hand, the object which is to be bound and the band are not subjected to excessively high loading. For this purpose, the tool is equipped with a band-tensioning-limiting device. In the case of a first tool type (EP-B 299 387; U.S. Pat. No. 5,915,425), the band-tensioning-limiting device is designed as a load balance in which the force acting in the band-tensioning device is compared with a reference force predetermined by a spring. If the force acting in the band-tensioning device exceeds the reference force, then the connection between the band-tensioning device and a band-gripping gripper is released. In the case of this tool type, the band-tensioning-measuring device is integrated mechanically in the band-tensioning-limiting device. The accuracy of the band-tensioning limitation is thus severely restricted. In addition, it is barely possible to set a band tensioning of predetermined magnitude. In the case of another type of tool (EP-B 733 549), the pressure in a pneumatic tensioning drive is compared, likewise via a type of load balance, with a reference force formed by an adjustable spring. The tensioning operation is terminated as soon as a set threshold has been reached. Although this achieves a higher level of accuracy than with the band-tensioning-limiting devices of purely mechanical construction, it is capable of improvement. The structural outlay is also comparatively high. If it is desired to determine the magnitude of the tensioning achieved, it is additionally necessary to provide an electronic pressure sensor with display device.

The disadvantages of the prior art are avoided according to the invention by the means of claim 1, and preferably by those of the subclaims.

SUMMARY OF THE INVENTION

Accordingly, a band-tensioning-measuring device which establishes the relationship between a lateral deflection of the band and the force necessary for this purpose is provided. An essential advantage of the invention is thus that the accuracy of the measurement is not impaired by design conditions which are predetermined in respect of limiting the band tensioning. A further important advantage is that the band tensioning is measured directly on the band itself. Electronic measurement also directly produces a display signal, which makes it possible to monitor the setting.

Deflection is to be understood as the band being guided, between a pair of band guides arranged on one side of said band, over a deflecting guide which is located on its other side and deflects the band in the direction of the side of the pair of band guides. The pair of band guides may be formed by guide parts which are provided in the tool anyway, for example by the lock mount, on the one hand, and the band-tensioning device, on the other hand. It is more expedient, however, for the pair of band guides to be provided separately, to be precise in a structural unit with the deflecting guide and preferably also the band-tensioning-measuring device, in order that the geometrical relationship defined by said structural unit itself, irrespective of other structural tolerances of the tool. It is highly advantageous here that the magnitude of the deflection can be very low, namely preferably smaller than a fifth, further preferably smaller than a tenth, and further preferably smaller than a twentieth, of the distance between the band guides. This presupposes that the deflecting guide is seated approximately centrally between the band guides. If it is arranged considerably more closely to one band guide than the other, the deflection should be correspondingly smaller. The advantage of the small deflection is that the band can be pushed through more or less rectilinearly and the band-advancement means can thus be arranged in front (i.e. on the side on which the band-tensioning device is also located). This makes it possible to use the same drive elements for the band-advancement means and the band-tensioning device.

The band-tensioning-measuring device is expediently designed such that the force on the deflecting guide is measured with a given magnitude of deflection. Conversely, it is also possible, however, to measure the magnitude of the deflection with a given deflecting force, the latter being determined, for example, by a spring. If an electronic measuring element is used as a band-tensioning-measuring device, the measuring distance is so small as to be more or less negligible. Moreover, in conjunction with the band-tensioning-measuring device being designed together with the band guide and deflecting guide as an independent structural unit, this has the advantage that said structural unit can be exchanged in its entirety for replacement or maintenance purposes. It may also be treated as an optional element, it being possible for one and the same tool type to be supplied with or without a band-tensioning-measuring device or it easily being possible for a tool supplied without a band-tensioning-measuring device to be retrofitted with such a device.

In one embodiment of the tool, the band-tensioning device is provided with an adjustable band-tensioning-limiting device, and a device is provided for setting the band tensioning, said device, for its part, being influenced by the band-tensioning-measuring device. The arrangement may be such that, during each binding operation, the band tensioning which is actually achieved and established by the band-tensioning-measuring device is compared with a stored desired value. If deviations are established outside a certain tolerance range, the band-tensioning-limiting device is adjusted correspondingly.

In another embodiment of the tool according to the invention, the band-tensioning device contains a device for terminating the tensioning operation, this device being controlled directly by the band-tensioning-measuring device. It is possible to provide, for example, an electric clutch which is opened whenever the band-tensioning-measuring device signals that a predetermined band tensioning has been achieved.

BRIEF DESCRIPTION OF THE DRAWING

The invention is explained in more detail hereinbelow with reference to the drawing, which gives a schematic illustration of an exemplary embodiment of the invention and in which.

DETAILED DESCRIPTION OF THE PREFERRED EMBODIMENT

Figure 1:
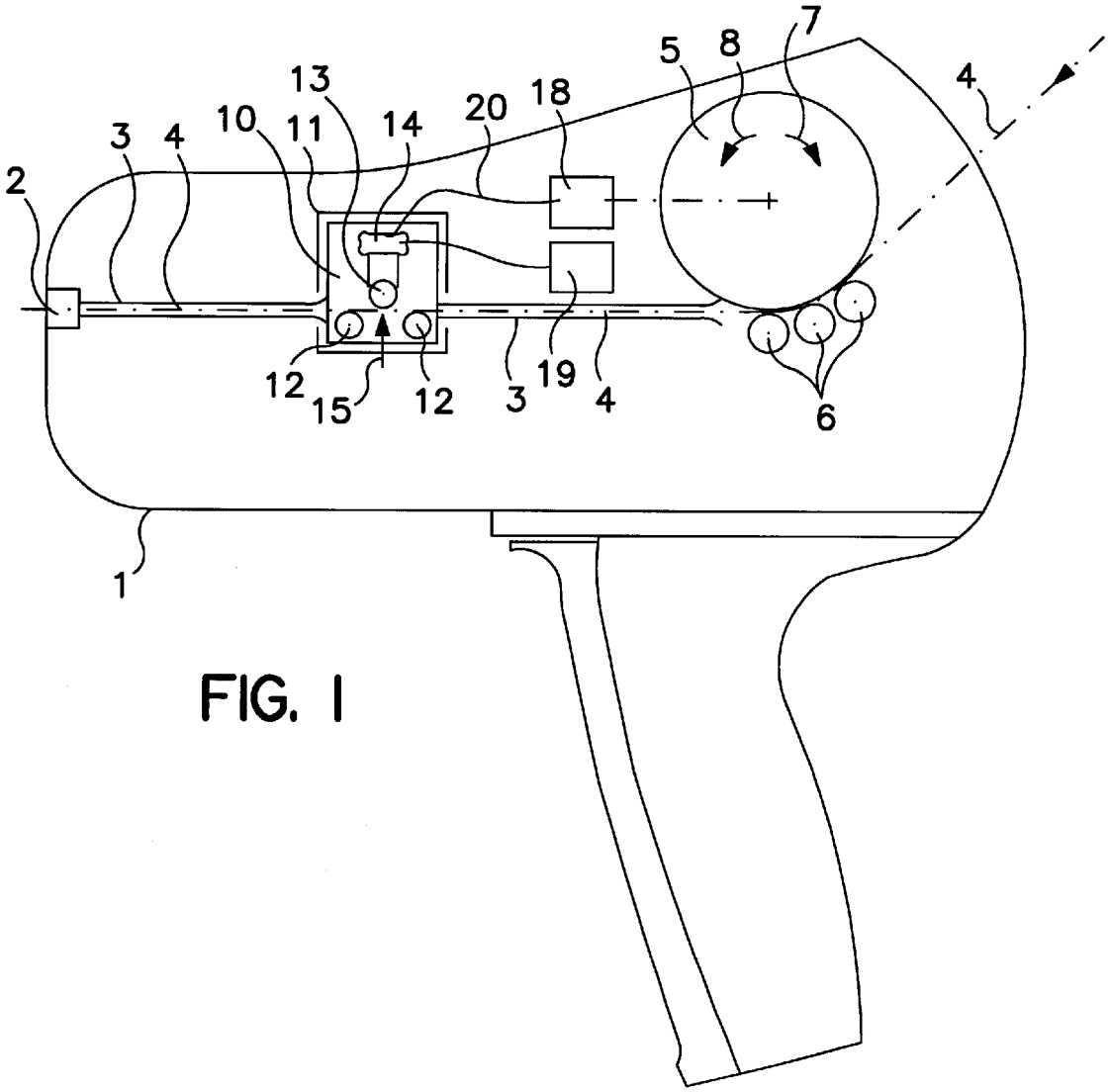
FIG. 1 shows a sectional view of a tool in respect of the parts which are essential in conjunction with the invention.

The housing 1 of the tool contains, in its end, a lock mount 2 in which a band channel 3 opens out, said channel guiding the band 4, which is indicated by chain-dotted lines, to a lock located in the lock mount 2, in order to be processed together with the latter in a known manner. During processing, the band 4 is advanced in order to be tied around the object which is to be bound. When its free end has been bound in the lock located in the lock mount 2, the band 4 is retracted in order for the loop tied around the object to be tensioned. A drive unit comprising the drive roller 5 and counterpressure rollers 6 serves for advancing and retracting the band. When the drive roller 5 is driven in the arrow direction 7, the band 4 is advanced. The drive unit then forms an advancement device. When it is driven in the arrow direction 8, it forms the tensioning device. To this extent, the arrangement may be regarded as being known (EP-B-297 337).

The band-tensioning-measuring device 10 is arranged between the lock mount 2 and the drive device 5, 6, said device 10 being accommodated in an easily exchangeable manner in a mount 11 which is specifically provided for this purpose in the housing 1. Like the band-guiding channel 3, it has the band 4 running through it in an essentially rectilinear manner. It contains a pair of guide rollers 12, which form the abovementioned band guides. Arranged centrally opposite these is a deflecting roller 13, which forms the abovementioned deflecting guide. The deflecting roller 13 is arranged on an electronic force-measuring device 14, which measures the force to which the deflection roller 13 is subjected in the arrow direction 15 by the band 4. The rollers 12, 13 are arranged such that the point of contact between the deflecting roller 13 and the band 4 is not much lower than the rectilinear line connecting the points of contact between the band-guiding rollers 12 and the band.

Figure 2:
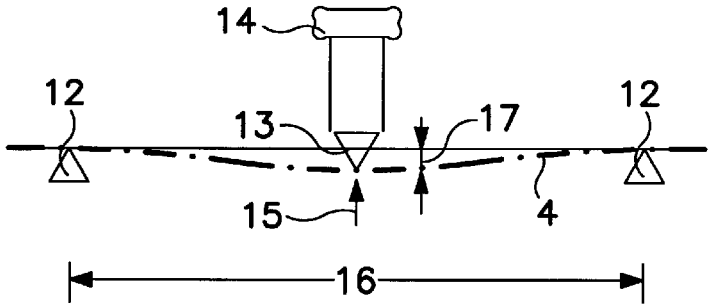
FIG. 2 shows a schematic illustration of the band deflection.

This is illustrated schematically on a larger scale in FIG. 2. The force 15 to which the band-tensioning-measuring device 14 is subjected by the band 4 only depends on the band tensioning. The relationship between this force and the band tensioning is determined by the geometrical relationship between the points 12 and 13, which is defined in a highly accurate and constant manner by the construction of the band-tensioning-measuring device. The signal produced by the band-tensioning-measuring device 14 and indicated in the display 19 may therefore be gaged directly as the band tensioning.

Let us assume that the drive roller 5 is driven via a slip clutch which can be set such that the slip torque corresponds to he maximum band tensioning desired. If the band tensioning achieved is read off from the display 19 during a number of trial binding operations, it is possible to set the slip clutch manually to the desired band tensioning.

This can also take place automatically if it is assumed that the unit 18 is a motor-driven adjusting device for the slip clutch. It is further presupposed that the unit 18 comprises a control device in which the desired band tensioning is stored and which, in the case of the signal transmitted via line 20 differing from the stored band tensioning, carries out corresponding adjustment of the slip clutch. This device will automatically ensure that the band-tensioning value determined by the slip clutch always equals the desired band tensioning, with a small tolerance.

Instead of this, it may also be assumed that the unit 18 is a clutch which connects the drive roller 5 to an associated motor or releases it therefrom. It may further be assumed that the unit 18 contains a control device which compares a set desired value for the band tensioning with the signal transmitted from the band-tensioning-measuring device 14 via line 20. The clutch is closed if the signal originating from the band-tensioning-measuring device is smaller than the set band tensioning. If the signal reaches this value, then the clutch is released and the tensioning operation is terminated.

What is claimed is:

1. A tool for binding a band around an object, having a lock mount for a lock which secures the band ends, and a band-tensioning device, wherein provided between the lock mount and the band-tensioning device is a band-tensioning-measuring device which deflects the band laterally and establishes the relationship between the deflection and the force necessary for this purpose.

2. The tool as claimed in claim 1, wherein the band is guided, between a pair of band guides arranged on one side of said band, over a deflecting guide which is located on its other side and deflects the band in the direction of the side of the pair of band guides.

3. The tool as claimed in claim 2, wherein the band-tensioning-measuring device is designed for measuring the force on the deflecting guide with a given magnitude of deflection.

4. The tool as claimed in claim 3, wherein the magnitude of the deflection is no greater than a fifth of the distance between the pair of band guides.

5. The tool as claimed in claim 3, wherein the magnitude of the deflection is no greater than a fifth of the distance between the pair of band guides.

6. The tool as claimed in claim 3, wherein the band-tensioning device comprises an adjustable band-tensioning-limiting device, and a device which is influenced by the band-tensioning-measuring device is provided for setting the band-tensioning-limiting device.

7. The tool as claimed in claim 2, wherein the band-tensioning-measuring device is designed for measuring the magnitude of the deflection with a given deflecting force.

8. The tool as claimed in claim 7, wherein the magnitude of the deflection is no greater than a fifth of the distance between the pair of band guides.

9. The tool as claimed in claim 7, wherein the magnitude of the deflection is no greater than a fifth of the distance between the pair of band guides.

10. The tool as claimed in claim 2, wherein the magnitude of the deflection is no greater than a fifth of the distance between the pair of band guides.

11. The tool as claimed in claim 2, wherein the pair of band guides is separate from the lock mount and/or the band-tensioning device.

12. The tool as claimed in claim 2, wherein the band-tensioning device comprises an adjustable band-tensioning-limiting device, and a device which is influenced by the band-tensioning-measuring device is provided for setting the band-tensioning-limiting device.

13. The tool as claimed in claim 2, wherein the band-tensioning device comprises a device which is controlled by the band-tensioning-measuring device and is intended for terminating the tensioning operation.

14. The tool as claimed in claim 1, wherein the magnitude of the deflection is no greater than a fifth of the distance between the pair of band guides.

15. The tool as claimed in claim 14, wherein the magnitude of the deflection is no greater than a fifth of the distance between the pair of band guides.

16. The tool as claimed in claim 1, wherein the pair of band guides is separate from the lock mount and/or the band-tensioning device.

17. The tool as claimed in claim 16, wherein the pair of band guides, the deflecting guide and the band-tensioning-measuring device form an independent structural unit.

18. The tool as claimed in claim 17, wherein the band-tensioning-measuring unit has an electrical measuring element.

19. The tool as claimed in claim 1, wherein the band-tensioning device comprises an adjustable band-tensioning-limiting device, and a device which is influenced by the band-tensioning-measuring device is provided for setting the band-tensioning-limiting device.

20. The tool as claimed in claim 1, wherein the band-tensioning device comprises a device which is controlled by the band-tensioning-measuring device and is intended for terminating the tensioning operation.

* * * * *